United States Patent [19]

Davis

[11] Patent Number: 4,795,399

[45] Date of Patent: Jan. 3, 1989

[54] BRASSIERE SHOULDER STRAP BEARING PAD

[76] Inventor: Walter W. Davis, Rte. 1, Box 1, Peachtree Hills, Murphy, N.C. 28906

[21] Appl. No.: 93,650

[22] Filed: Sep. 8, 1987

[51] Int. Cl.[4] ..... A41D 27/26; A41C 3/00; A41C 3/12

[52] U.S. Cl. ..... 450/86; 2/2; 2/267; 2/268

[58] Field of Search ..... 2/268, 2; 450/86

[56] References Cited

U.S. PATENT DOCUMENTS

| | | | |
|---|---|---|---|
| 3,050,734 | 8/1962 | Dopyera | 2/268 X |
| 3,154,787 | 11/1964 | Newman | 2/268 X |
| 4,612,935 | 9/1986 | Greifer | 2/268 X |

*Primary Examiner*—Werner H. Schroeder

*Assistant Examiner*—Jeanette E. Chapman

*Attorney, Agent, or Firm*—Alan Ruderman

[57] ABSTRACT

A bearing pad readily attachable to a brassiere strap for positioning between the strap and the skin of the wearer of the brassiere to prevent the strap digging into and irritating the wearer's shoulder. The pad is an elongated member having two plies of dissimilar material, the upper ply being a rigid stiff material relative to the lower ply which is a soft cushion-like material. The upper ply may be a high density polyethylene synthetic plastic, and the lower ply a non-woven polyester fabric. The upper ply includes a first pair of tabs spaced from a second pair of tabs, each pair of tabs being adapted to be lifted from the surface of the upper ply for permitting the brassiere strap to be received between the tabs and the surface of the ply in adjustable fashion.

3 Claims, 1 Drawing Sheet

BRASSIERE SHOULDER STRAP BEARING PAD

BACKGROUND OF THE INVENTION

This invention relates to brassieres and more particularly to a bearing pad for distributing the forces applied by the brassiere straps to the shoulders of a woman.

It is known that the shoulder straps of brassieres worn by women create an uncomfortable irritating indentation in the skin of the shoulders overwhich the straps extend. This is especially true in the case of full figured women and women who desire a large uplifting wherein the straps are tightly strung and dig into the skin of the shoulders.

Prior art attempts to provide bearing pads for relieving such strap irritation have not proved successful. In one known attempt a strip of fabric was carried by the strap, the strap being inserted through slots in the strip which was interposed between the strap and the skin The problem with this and with the other known attempts at a solution is that the strip of material used is too flimsy to prevent the impression of the strap from being superposed through the strip onto the skin of the shoulder.

SUMMARY OF THE INVENTION

Consequently, it is a primary object of the present invention to provide a pad for brassiere shoulder straps which effectively prevents the straps from digging into the skin of a wearer's shoulder.

It is another object of the present invention to provide an inexpensive pad which may be readily attached to the shoulder strap of a brassiere to prevent the strap from digging into and irritating the wearer's shoulder.

It is a further object of the present invention to provide a pad readily attachable to a brassiere shoulder strap, the pad comprising a relatively rigid firm upper ply of material having means for attachment to the strap and a lower ply of soft comfortable cushion material joined to the upper ply, the lower ply being engageable with the shoulder of the wearer, the pad being sized for positioning over the crest of the shoulder.

Accordingly, the present invention provides a bearing pad readily attachable to a brassiere strap for disposition on the shoulder of a wearer, the pad having upper and lower plies of material secured together, the upper ply comprising a bearing surface for the brassiere strap and being a firm rigid material capable of withstanding the force on the brassiere strap without having an impression left therein, the lower ply comprising a soft fabric material for acting as a cushion against the skin of the shoulder of the wearer, and tabs formed in the upper ply for adjustably receiving the strap which is superposed on the upper surface.

In the preferred embodiment, the upper ply of the pad comprises a high density polyethylene synthetic plastic sheet material while the lower ply comprises a non-woven material formed from polyester synthetic plastic fiber, the pad having an oblong configuration symmetrical about both axes and convexly arcuate at the longitudinally remote ends, the plies being secured together adjacent the periphery. The strap receiving tabs preferably are formed by a pair of longitudinally spaced apart matrix of slits, each matrix being a pair of laterally spaced slits interconnected by a longitudinally extending slit.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
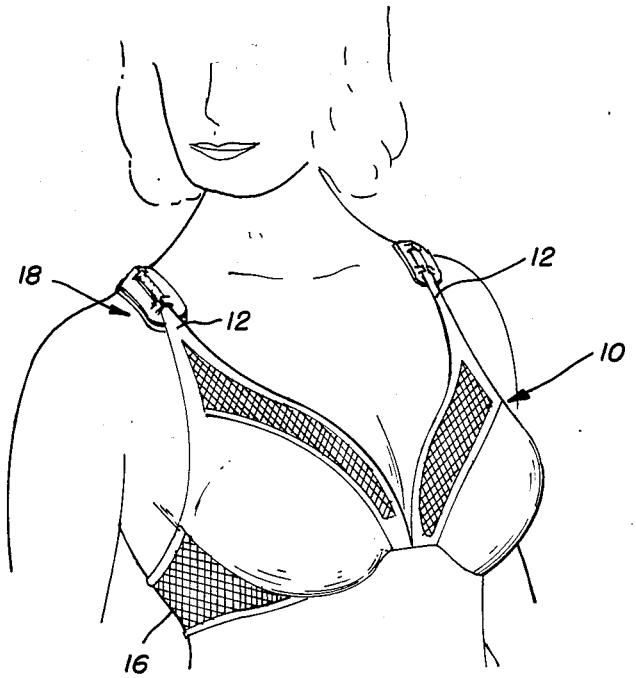
FIG. 1 is a front perspective view of a person wearing a brassiere having pads on each shoulder strap constructed in accordance with the principles of the present invention.

Referring now to the drawings, a brassiere 10 of conventional form is illustrated as normally worn, the brassiere having shoulder straps 12 extending from the upper section of the halter portion and, although not illustrated, being attached to the back of the body encircling band 16. As aforesaid, and as is well known, the shoulder straps 12, especially if taut, will dig into the wearer's shoulder and create an irritating impression or indentation in the skin. Accordingly, the present invention provides a bearing pad 18 for use with each strap 12 so as to be disposed between the strap and the skin of the wearer's shoulder.

Figure 2:
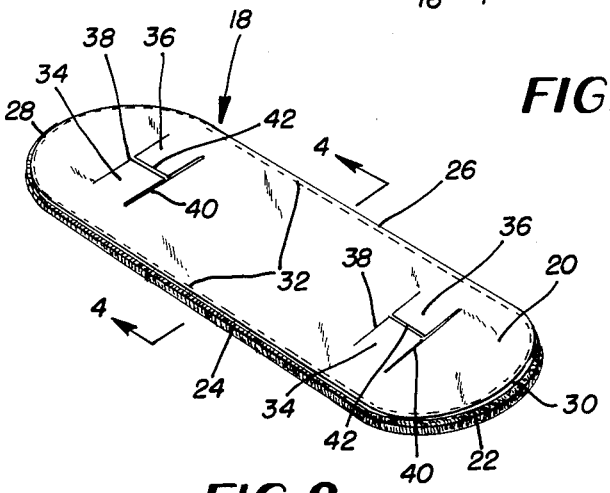
FIG. 2 is a perspective view of one of the pads illustrated in FIG. 1 on a greatly enlarged scale.
Figure 3:
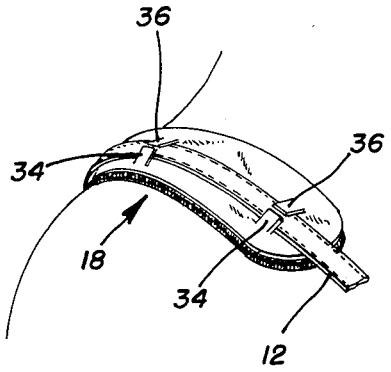
FIG. 3 is a perspective view of the pad and a portion of the brassiere strap of FIG. 1 enlarged to illustrate the attachment therebetween.
Figure 4:
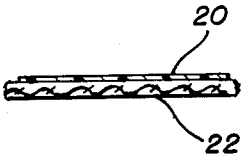
FIG. 4 is a cross sectional view taken substantially through line 4—4 of FIG. 2.

As best illustrated in FIG. 2, the pad 18 comprises an elongated composite member having an upper ply 20 of a bendable but relatively rigid material for contacting the brassiere strap 12 and a lower ply 22 of a soft cushion-like material which contacts the skin. The shape of the pad should be such that it has no sharp edges which could cut or irritate the skin of the wearer's shoulder, and preferably, as illustrated, may be of an oblong form having substantially straight lateral edges 24, 26 and arcuately convex smooth ends 28, 30. Although the size of the pads may vary it has been found that a pad having a longitudinal length of approximately 5 to 5¼ inches by a lateral width of approximately 2 inches may be ideal.

A stiff form of high density polyethylene synthetic plastic, such as the material generally used for forming extruded bottles, has been found to perform ideally for the upper ply when having a thickness of approximately 1 millimeter. This material is relatively rigid and incompressible but is flexible enough to bend when squeezed or pulled against the shoulders, yet will not indent under the force of the brassiere strap. Additionally, such material may be readily cut by stamping or the like into the desired form from large sheets. Other materials, such as cardboard of appropriate thickness, may be utilized for the upper ply, but since it is preferred that the pads be washable, synthetic plastic materials are ideally suited for these purposes. For example, in addition to polyethylene, vinyl and similar materials having an appropriate thickness to have the desired rigidity, surface hardness and incompressiblity may be utilized.

The lower ply 22 preferably is formed from a non-woven fabric sheet of polyester fiber which has the requisite softness, the thickness of such material may be in the order of approximately 3 to 4 millimeters which provides the desired cushioning effect. Additionally, the cushioning material of the lower ply may protrude a small amount about the periphery relative to the upper ply to ensure that only the lower ply will touch the shoulder of the wearer, the amount of protrusion being in the order of approximately ⅛ inch. Other synthetic materials of similar low density, softness and comfort may also be used, as may cotton batting or the like.

The upper and lower plies 20 and 22 may be fastened together by stitches, such as illustrated at 32, sewn about the plies adjacent to the periphery, or the plies may be bonded by heat or may be glued together, depending on specific material selected for the two plies.

Prior to fastening the upper and lower plies together, and preferably at the time of forming the upper ply 20, two sets of strap securing tabs 34, 36 may be formed at spaced apart locations. Each set of tabs 34, 36 preferably is formed by laterally extending slits 38, 40 cut into the upper ply and interconnected by a longitudinal slit 42, the slit 42 being substantially along the axis of elongation of the pad. The tabs 34, 36 thus formed can be flipped or lifted relative to the surface of the upper ply, and the brassiere strap 12 thus may be inserted beneath the tabs as illustrated to provide a quick and easy attachment and detachment therefrom, yet permit slidable adjustment of the pad along the brassiere strap.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A bearing pad for brassiere shoulder straps to alleviate irritating indentations to the skin of a wearer, said pad comprising a composite elongated member having two plies of material fastened together, one of said plies defining an upper ply adapted to engage one of the shoulder straps to act as a bearing surface therefore, the other ply defining a lower ply for contacting the skin of the wearer, said upper ply comprising a rigid stiff high density polyethylene synthetic plastic material so as not to indent when forcibly engaged by the brassiere strap and of a thickness such that it may be resiliently urged to conform to the shoulder of the wearer when the brassiere strap is taut, said lower ply comprising a low density soft non-woven cushion material comprising polyester fibers, and attaching means formed in the upper ply for entrapping the brassiere strap while permitting the pad to adjustably slide along the strap for positioning on the shoulder of the wearer, said attaching means comprising two pairs of tabs, one pair being spaced from the other pair in the direction of elongation of said pad, each pair of tabs comprising first and second spaced apart slits formed in the upper ply transverse to the direction of elongation of the pad and interconnected by a third slit extending in the direction of elongation to separate the tabs and permit the tabs to be lifted from the remainder of the upper ply for receiving the brassiere strap beneath the tabs while the tabs rest on the surface of the upper ply intermediate the two pairs.

2. A bearing pad as recited in claim 1, wherein said upper ply is approximately one millimeter thick.

3. A bearing pad as recited in claim 2, wherein said lower ply is approximately three to four millimeters thick.

* * * * *